US006727794B2

(12) United States Patent
Busletta et al.

(10) Patent No.: US 6,727,794 B2
(45) Date of Patent: Apr. 27, 2004

(54) APPARATUS FOR ESTABLISHING INDUCTIVE COUPLING IN AN ELECTRICAL CIRCUIT AND METHOD OF MANUFACTURE THEREFOR

(75) Inventors: Galliano Ricardo Busletta, Mesquite, TX (US); Peter Mignano, Austin, TX (US); Robert Joseph Roessler, Rockwall, TX (US); Matthew Anthony Wilkowski, Mesquite, TX (US)

(73) Assignee: Tyco Electronics Logistics, A.G., Steinach (CH)

( * ) Notice: Subject to any disclaimer, the term of this patent is extended or adjusted under 35 U.S.C. 154(b) by 64 days.

(21) Appl. No.: 09/961,492

(22) Filed: Sep. 22, 2001

(65) Prior Publication Data

US 2003/0058078 A1 Mar. 27, 2003

(51) Int. Cl.[7] ..... H01F 5/00
(52) U.S. Cl. ..... 336/200; 336/232
(58) Field of Search ..... 336/83, 65, 90, 336/98, 199, 200, 208, 221, 225, 232

(56) References Cited

U.S. PATENT DOCUMENTS 5,430,613 A * 7/1995 Hastings et al. ..... 336/200
5,781,091 A 7/1998 Krone et al.
5,959,846 A * 9/1999 Noguchi et al. ..... 336/200

FOREIGN PATENT DOCUMENTS

JP 58-53807 * 3/1983

* cited by examiner

*Primary Examiner*—Tuyen T. Nguyen
(74) *Attorney, Agent, or Firm*—Law Office of Donald D. Mondul

(57) ABSTRACT

An apparatus for establishing inductive coupling in an electrical circuit arranged on a plurality of dielectric substrates, the substrates being in a substantially abutting relationship and presenting a plurality of substantially parallel planar expanses, includes: (a) at least one first core segment situated in at least one first depression provided in a first planar expanse; (b) at least one second core segment situated in at least one second depression provided in a second planar expanse; (c) a selected second core segment is arranged for establishing magnetic flux coupling with a selected first core segment to establish a magnetic core structure; (d) a plurality of electrically conductive through-hole structures traverse at least one substrate; (e) a plurality of electrically conductive circuit traces are arrayed upon at least two of the planar expanses. The conductive traces and the through-hole structures cooperate to establish inductive coupling.

12 Claims, 5 Drawing Sheets

APPARATUS FOR ESTABLISHING INDUCTIVE COUPLING IN AN ELECTRICAL CIRCUIT AND METHOD OF MANUFACTURE THEREFOR

BACKGROUND OF THE INVENTION

The present invention is directed to electrical inductive circuit elements, such as inductors and transformers, and especially to small electrical inductive circuit elements having a low profile that may be reliably and economically manufactured in production quantities.

Prior art inductive elements that require a magnetic core structure commonly provide a cutout aperture through a dielectric substrate for insertion of a ferromagnetic or other magnetic core structure. The core structure may already bear the required windings for effecting inductive coupling, or the required windings may be incorporated into circuit traces arrayed upon the substrate. There are problems with using such a structure, especially in applications where small inductive circuitry having a low profile is desired. Chief among the problems with such an approach are the room required to accommodate an inductive element and its supporting electrical circuitry. In addition, the large size of prior art inductive circuitry necessitates situating associated circuit elements a distance removed from the inductive element. Such physical separation among circuit elements introduces capacitance and inductance into the circuit as well as increased trace lengths, all of which may contribute to increased losses. Such an introduction of capacitive and inductive factors into circuitry is a problem in power supply output circuits as well as in any LC (inductance-capacitance) filter application; the increased capacitances and inductances reduce transient response of such circuits and increase losses.

An attempt to ameliorate the problems associated with assembling inductive circuit elements is described in U.S. Pat. No. 5,781,091 issued Jul. 14, 1998 to Krone, et al. for "Electronic Inductive Device and Method for Manufacturing". Krone, et al. describe an assembly structure and process for manufacturing that structure that provides an inner board layer with an aperture. The apertured inner board layer is situated atop a laminate that includes an insulating layer and a copper foil layer. The insulating layer faces the inner board. The aperture is partially filled with a thin layer of fiber filled epoxy and a ferromagnetic core is installed within the aperture atop the fiber filled epoxy layer. Another layer of fiber filled epoxy is added on top of and within the center of the core completely covering the core and embedding the core in the fiber filled epoxy, an insulating material. A second laminate similar to the first laminate is then applied atop the inner board to complete a board stack, with the insulating layer of the second laminate facing the inner board.

Plated through-hole structures are provided traversing the board stack; circuit traces are created on outer faces of the board stack by etching the copper foil layers. The circuit traces are connected with the through-hole structures to establish electrical paths that encircle the core thereby establishing an inductive coupling circuit with the core.

One shortcoming of the Krone, et al. structure relates to the employment of fill material within the aperture that covers the core. The magnetic core is placed within an aperture that is filled with a material that is at least somewhat viscous at temperatures encountered during processing steps contemplated by Krone et al. As a consequence, the core is liable to "float" within the aperture during processing. The varied positioning that a core may assume during processing because of such an ability to float means that the through-hole structures required by Krone et al. for forming loops about the core for inductive coupling may not be placed with respect to the core to avoid intercepting the core. That is, the cores can float sufficiently that one may intercept the core while drilling or otherwise forming the through-holes. This placement precision limitation presents less of a problem for inductive devices that are sufficiently large. However, for inductors that are small enough to be useful in today's circuits for such applications as board mounted power supply products or the like, the size of the core is sufficiently small that manufacturing yields for such products will be too low to make the use of the Krone et al. structure an economically worthwhile approach. Further, the tolerances that are required for producing the Krone et al. structure are likely to be too large to permit fabrication of products small enough for use as board mounted power supply products.

There is a need for an improved structure for electrical inductive element and method for manufacture of the element that provides precision manufacturing of small power products with tightly controllable tolerances.

SUMMARY OF THE INVENTION

An apparatus for establishing inductive coupling in an electrical circuit arranged on a plurality of dielectric substrates, the plurality of dielectric substrates being in a substantially abutting relationship and presenting a plurality of substantially parallel planar expanses, includes: (a) at least one first core segment situated in at least one first depression provided in a first planar expanse of the plurality of planar expanses; (b) at least one second core segment situated in at least one second depression provided in a second planar expanse of the plurality of planar expanses; (c) a selected second core segment arranged for establishing magnetic flux coupling with a selected first core segment to establish a selected magnetic core structure; (d) a plurality of electrically conductive through-hole structures traversing at least one substrate of the plurality of substrates; (e) a plurality of electrically conductive circuit traces arrayed upon at least two planar expanses of the plurality of planar expanses. The plurality of conductive traces and the plurality of through-hole structures cooperate to effect establishing inductive coupling.

The method for manufacturing the apparatus produces an electrical circuit arranged on at least one dielectric substrate. The electrical circuit establishes inductive coupling with a magnetic core structure. The at least one substrate presents a plurality of substantially parallel planar expanses. The method includes the steps of: (a) providing at least one substrate; (b) creating a first depression in a first planar expanse of the plurality of planar expanses; (c) creating a second depression in a second planar expanse of the plurality of planar expanses; a portion of the second depression being substantially in register with a portion of the first depression; (d) situating a first core segment in the first depression; (e) situating a second core segment in the second depression; the first core segment effects magnetic flux coupling with the second core segment to establish a magnetic core structure; (f) providing a plurality of electrically conductive circuit traces arrayed on at least two of the planar expanses; (g) providing a plurality of electrically conductive through-hole structures traversing at least one substrate; (h) coupling the plurality of conductive traces and the plurality of through-hole structures to effect establishing inductive coupling.

It is, therefore, an object of the present invention to provide an apparatus for establishing inductive coupling in an electrical circuit, and a method for manufacture therefor, that facilitates precision manufacturing of small power products with tightly controllable tolerances.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

For purposes of this description throughout, the term "magnetic" is considered to be substantially synonymous with the terms "ferrous", "ferromagnetic", and "magnetizable".

Figure 1:
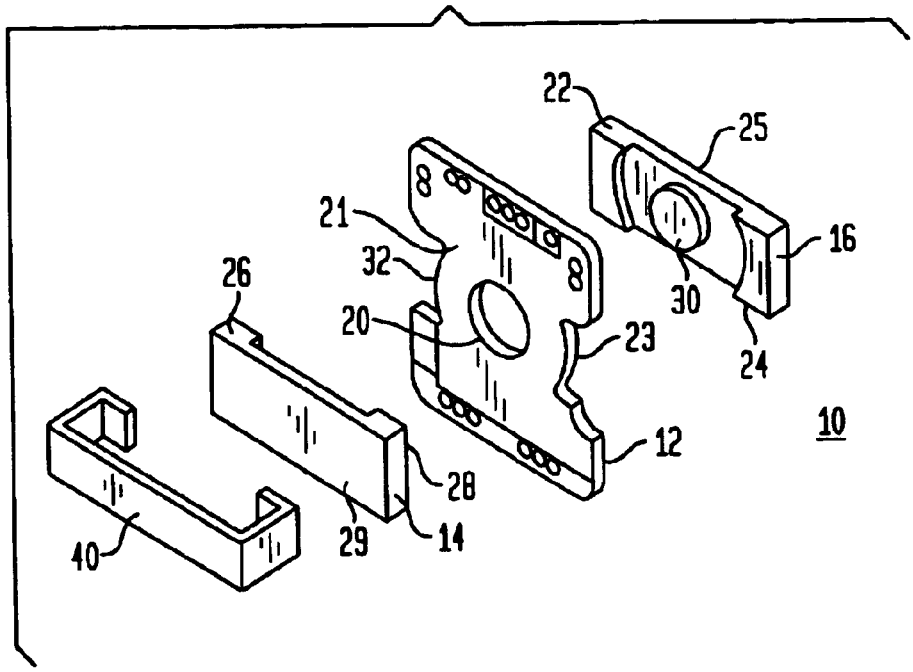
FIG. 1 (PRIOR ART)
FIG. 1 is a perspective exploded view illustrating a prior art inductive circuit element poised for assembly.

FIG. 1 is a perspective exploded view illustrating a prior art inductive circuit element poised for assembly. In FIG. 1, an inductive circuit element 10 includes a printed wiring board substrate 12, and ferrite elements 14, 16. Substrate 12 has an aperture 20 therethrough. Ferrite elements 14, 16 are preferably substantially symmetric. Ferrite element 14 includes a pair of raised end portions 22, 24 extending from a base portion 25. Ferrite element 16 includes a pair of raised end portions 26, 28 extending from a base portion 29. Ferrite element 16 includes a center post 30 extending from base portion 25 in the same direction as end portions 22, 24 extend. Ferrite element 14 has a similar center post extending from base portion 29 in the same direction as end portions 26, 28 extend (not visible in FIG. 1).

During assembly ferrite elements 14, 16 are positioned together with substrate 12 between ferrite elements 14, 16. Center post 30 (and its mating center post extending from ferrite element 14 meet through aperture 20. End portions 22, 26 meet at a cutout 32 provided in substrate 12. End portions 24, 28 meet at a cutout 23 provided in substrate 12.

A clip 40 may be provided to securely grippingly assemble substrate 12 with ferrite elements 14, 16. Other attachment mechanisms may be employed in assembling inductive circuit element 10, such as adhesive between raised end portions 22, 26, between raised end portions 24,28 and between center post 30 and a similar center post on ferrite element 14 (not visible in FIG. 1).

Windings (not shown in FIG. 1) may be arranged about ferrite elements 14, 16 or arranged about center post 30 (and its mating center post extending from ferrite element 14; not visible in FIG. 1) to establish inductive coupling with ferrite elements 14, 16. Windings may be embodied in a variety of structures (not shown in FIG. 1). For example, windings may be embodied in a winding bundle nestled about center post 30 and its mating center post extending from ferrite element 14. Another example of an embodiment of a winding structure for effecting inductive coupling with ferrite elements 14, 16 is one or more circuit traces arranged on substrate 12.

Figure 2:
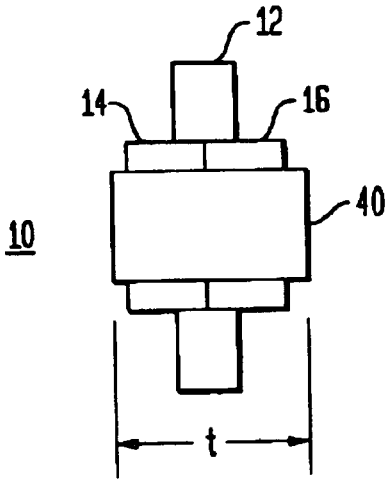
FIG. 2 (PRIOR ART)
FIG. 2 is a side view of the inductive circuit element of FIG. 1 in an assembled orientation.

FIG. 2 is a side view of the inductive circuit element of FIG. 1 in an assembled orientation. In FIG. 2, inductive circuit element 10 includes substrate 12 situated between ferrite elements 14, 16. Clip 40 holds substrate 12, and ferrite elements 14, 16 in a unitary package. Inductive circuit element 10 extends a thickness t measured across the maximum expanse from ferrite element 14 to ferrite element 16. It is the thickness t that needs reduction in order that inductive circuit element 10 may be better employed in the increasingly compact products being required today. That is, reduction of thickness t makes inductive circuit element 10 a lower profile circuit element.

Figure 3:
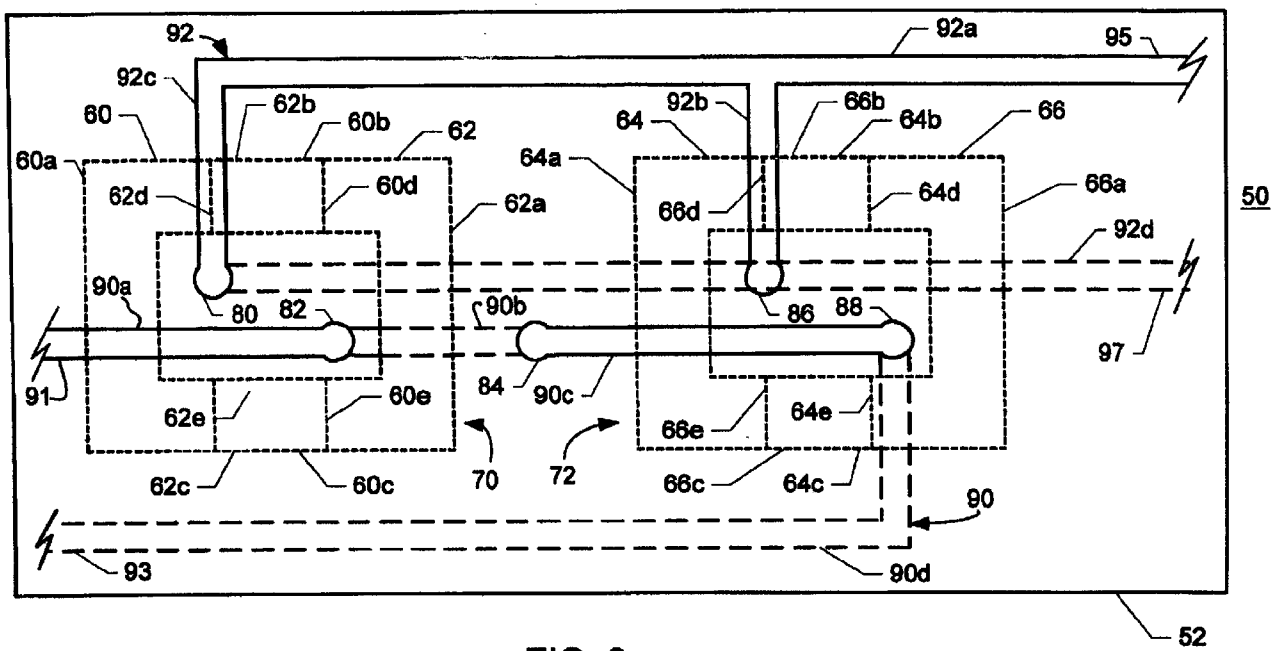
FIG. 3 is a top plan view of the preferred embodiment of an inductive circuit element according to the present invention.

FIG. 3 is a top plan view of the preferred embodiment of an inductive circuit element according to the present invention. In FIG. 3, an inductive circuit element 50 includes a base member 52 and magnetic or ferromagnetic core segments 60, 62, 64, 66 arrayed in base member 52. Each of core segments 60, 62, 64, 66 is a substantially U-shaped element having a base or bight section and a pair of legs extending from the base or bight member. Core segments may be configured to result in an "EI" core element, or an "EE" core element or another shape of core element. The U-shaped element formed by core segments 60, 62, 64, 66 is described here by way of example and not by way of limitation. Thus, core segment 60 has a base or bight member 60*a* and legs 60*b*, 60*c* extending from base member 60*a* to leg ends 60*d*, 60*e*. Core segment 62 has a base or bight member 62*a* and legs 62*b*, 62*c* extending from base member 62*a* to leg ends 62*d*, 62*e*. Core segment 64 has a base or bight member 64*a* and legs 64*b*, 64*c* extending from base member 64*a* to leg ends 64*d*, 64*e*. Core segment 66 has a base or bight member 66*a* and legs 66*b*, 66*c* extending from base member 66*a* to leg ends 66*d*, 66*e*. Core segments 60, 62 are situated appropriately with legs 60*b*, 62*b* in overlapping relationship and with legs 60*c*, 62*c* in overlapping relationship to establish magnetic flux coupling and cooperate to establish a ferromagnetic core structure 70. Core segments 64, 66 are situated appropriately with legs 64*b*, 66*b* in overlapping relationship and with legs 64*c*, 66*c* in overlapping relationship to establish magnetic flux coupling and cooperate to establish a ferromagnetic core structure 72.

Electrically conductive through-hole structures 80, 82, 84, 86, 88 traverse base member 52 to provide electrical continuity through base member 52. Circuit traces are arrayed on base member 52 to complete electrical circuit paths that cooperate with through-hole structures 80, 82, 84, 86, 88 and ferromagnetic core structures 70, 72 in effecting inductive coupling. The inductive coupling that may be effected by such cooperation may establish an inductor structure, a transformer structure or another inductively coupled structure. FIG. 3 (and FIG. 4) illustrates an inductive coupling embodied in a 2:1 transformer structure. Thus, a circuit trace 90 representing, for example, a primary turn in a transformer includes a trace segment 90*a* on the top side of base member 52 from a start locus 91 to connect with through-hole structure 82. Such connection (and other similar connections or couplings described herein) are preferably effected using solder coupling; other electrical coupling technologies may also be employed. A second trace segment 90*b* on the bottom side of base member 52 couples through-hole structure 82 with through-hole structure 84. Another trace segment 90*c* on the top side of base member 52 couples through-hole structure 84 with through-hole structure 88. Yet another trace segment 90*d* on the bottom side of base member 52 couples through-hole structure 88 with an end locus 93.

In such manner, there is a continuous electrical path established by circuit trace 90 in cooperation with through-hole structures 82, 84, 88 to establish a single turn of an electrical conductor through ferromagnetic core structure 70 and establish a single turn of an electrical conductor through ferromagnetic core structure 72. Electrical connection may be made with start locus 91 and end locus 93 to include primary circuit trace 90 in an external electrical circuit (not shown in FIG. 3).

A second circuit trace 92 representing, for example, secondary turns in a transformer includes a trace segment 92*a* on the top side of base member 52 from a start locus 95 to connect with trace segments 92*b*, 92*c*. Trace segment 92*b* on the top side of base member 52 connects trace segment 92*a* with through-hole structure 86. Trace segment 92*c* on the top side of base member 52 connects trace segment 92*a* with through-hole structure 80. A trace segment 92*d* on the bottom side of base member 52 couples through-hole structures 80, 86 with an end locus 97.

In such manner, there is a continuous electrical path established by circuit trace 92 in cooperation with through-hole structures 80, 86 to establish two parallel single turns of an electrical conductor through ferromagnetic core structures 70, 72. Electrical connection may be made with start locus 95 and end locus 97 to include secondary circuit trace 92 in an external electrical circuit (not shown in FIG. 4).

Figure 4:
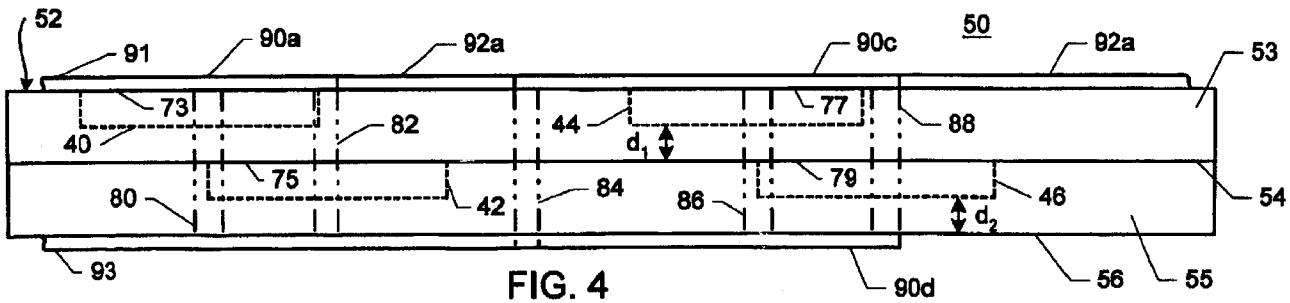
FIG. 4 is a side view of the inductive element of FIG. 3.

FIG. 4 is a side view of the inductive element of FIG. 3. In FIG. 4, inductive circuit element 50 is arrayed in a base member 52. Base member 52 includes a top substrate 53 and a bottom substrate 55. Through-hole structures 80, 82, 84, 86, 88 traverse top substrate 53 and bottom substrate 55 to provide electrical continuity among circuit traces 90, 92 as described by way of example in the exemplary circuit trace structure illustrated in FIG. 3 (only portions of circuit traces 90, 92 are visible in FIG. 4).

Depressions 40, 44 are established in top substrate 53 appropriately dimensioned to nestlingly receive magnetic core segments 60, 64. Depressions 42, 46 are established in bottom substrate 55 appropriately dimensioned to nestlingly receive magnetic core segments 62, 66. Depressions 40, 44 partially extend into top substrate 53 leaving a distance $d_1$ separation from depressions 40, 42 to the lower boundary 54 of top substrate 53. Depressions 42, 46 partially extend into bottom substrate 55 leaving a distance $d_2$ separation from depressions 42, 46 to the lower boundary 56 of bottom substrate 55. By such an arrangement a separation distance $d_1$ is established between depressions 40, 42 and between depressions 44, 46, so that a similar separation distance $d_1$ is established between magnetic core segments 60, 62 and between magnetic core segments 64, 66. Separation distance $d_1$ is preferably established at a dimension to permit magnetic flux coupling between magnetic core segments 60, 62 and between magnetic core segments 64, 66.

Magnetic core segments 60, 62, 64, 66 have respective upper faces 73, 75, 77, 79. Preferably, magnetic core segments 60, 62, 64, 66 are proportioned to be substantially fully received within respective depressions 40, 42, 44, 46 so that magnetic core segments 60, 62, 64, 66 present respective upper faces 73, 75, 77, 79 substantially flush with associated substrates 53, 55.

Figure 5:
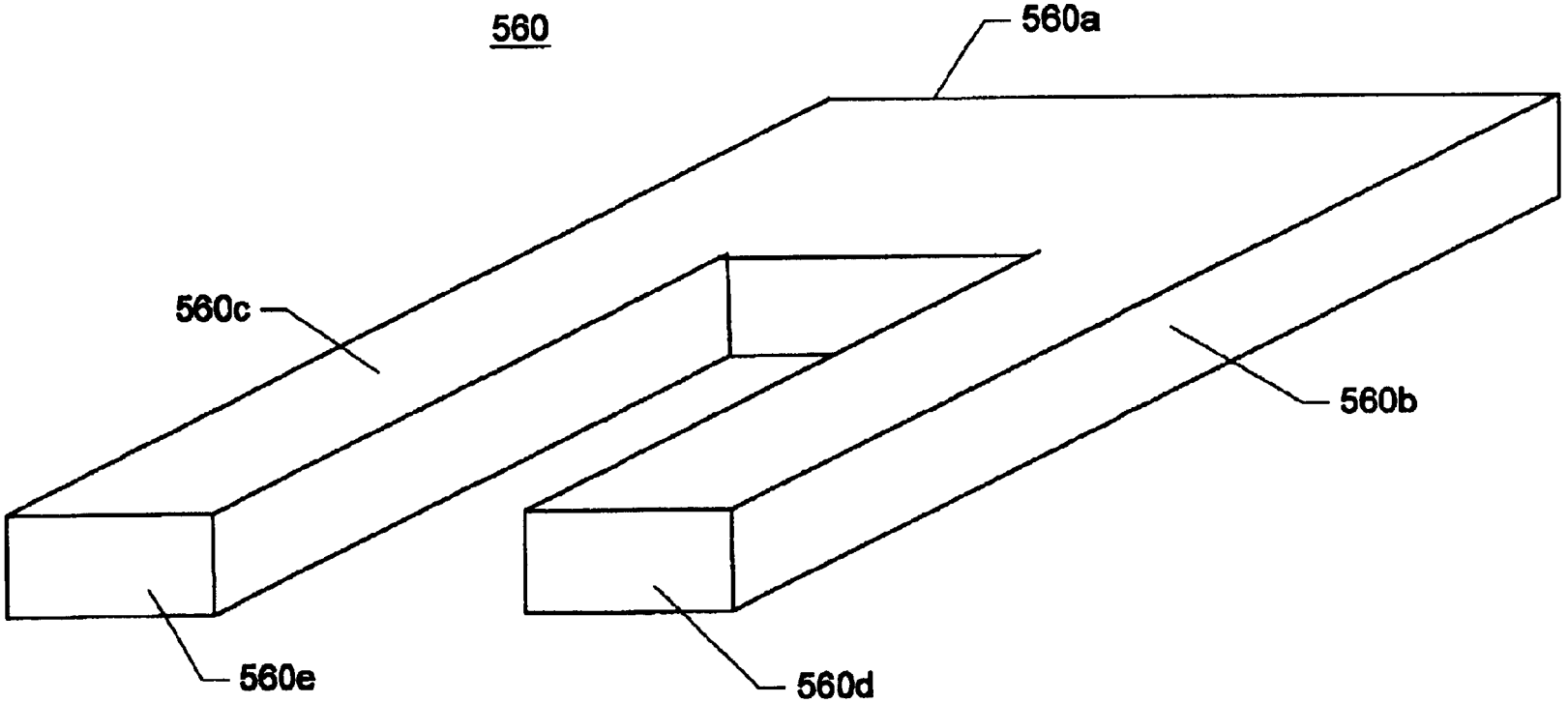
FIG. 5 is a perspective view of the preferred embodiment of a core segment for use with the present invention.

FIG. 5 is a perspective view of the preferred embodiment of a core segment for use with the present invention. In FIG. 5, a magnetic core segment 560 is preferably a substantially planar ferrous piece having a base or bight member 560*a* and legs 560*b*, 560*c* extending from base member 560*a* to leg ends 560*d*, 560*e*. In its preferred embodiment magnetic core segment 560 is a pliable magnetic material. Examples of such pliable magnetic material include magnetically loaded paste materials and magnetically loaded composite sheet materials, such as ferrite polymer composite materials. The magnetic materials of which magnetic core segment 560 is made may include a distributed air gap within the material. Such a distributed air gap construction facilitates establishing a plurality of magnetic core segments 560 (see, for example, magnetic core segments 60, 62 and magnetic core segments 64, 66; FIGS. 3 and 4) to provide a magnetic reluctance path on one layer (e.g., top substrate 53; FIG. 4) that is transferred to another layer (e.g., bottom substrate 55; FIG. 4). By making magnetic core segments 560 using magnetic material having a distributed air gap, there need not be an air gap provided in inter-layer transitions of a magnetic element. By way of example, magnetic core segments 60, 62 (FIGS. 3 and 4) could be situated in facing abutting relationship at lower boundary 56 of top substrate 53, if desired, if magnetic core segments 60, 62 are manufactured using such a material having a distributed air gap.

Figure 6:
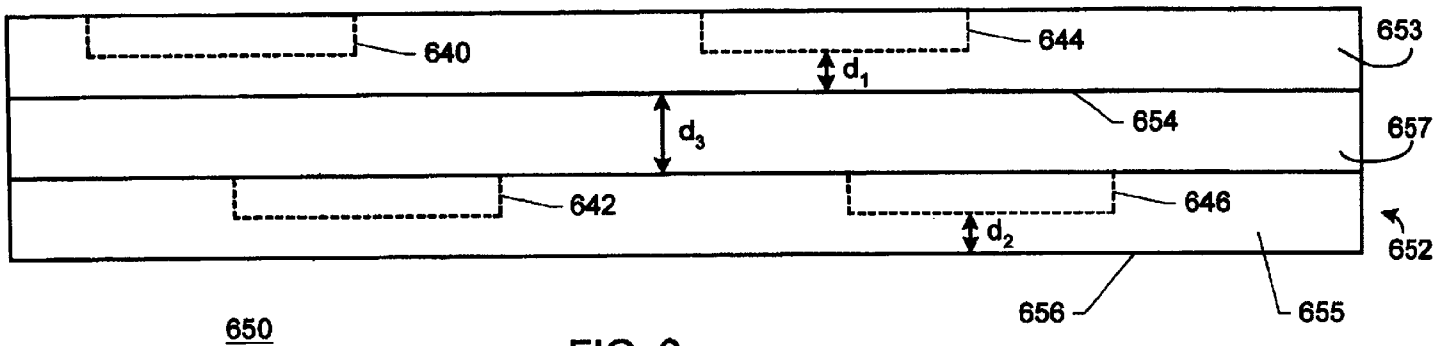
FIG. 6 is a simplified side view of the inductive circuit element illustrated in FIG. 3 showing an alternate placement arrangement for magnetic core segments.

FIG. 6 is a simplified side view of the inductive circuit element illustrated in FIG. 3 showing an alternate placement arrangement for magnetic core segments. In FIG. 6, an inductive circuit element 650 is arrayed in a base member 652. Base member 652 includes a top substrate 653, a bottom substrate 655 and a middle substrate 657.

Depressions 640, 644 are established in top substrate 653 appropriately dimensioned to nestlingly receive magnetic core segments (e.g., magnetic core segments 60, 64; FIG. 3). Depressions 642, 646 are established in bottom substrate 655 appropriately dimensioned to nestlingly receive magnetic core segments (e.g., magnetic core segments 62, 66; FIG. 3). Depressions 640, 644 partially extend into top substrate 653 leaving a distance $d_1$, separation from depressions 640, 644 to the lower boundary 654 of top substrate 653. Depressions 642, 646 partially extend into bottom substrate 655 leaving a distance $d_2$ separation from depressions 642, 646 to the lower boundary 656 of bottom substrate 655. Middle substrate 657 has a thickness $d_3$. By such an arrangement a separation distance $(d_1+d_3)$ is established between depressions 640, 642 and between depressions 644, 646, so that a similar separation distance $(d_1+d_3)$ is established between magnetic core segments situated within depressions 640, 642 and between magnetic core segments situated within depressions 644, 646. Separation distance $(d_1+d_3)$ is preferably established at a dimension to permit magnetic flux coupling between magnetic core segments situated within depressions 640, 642 and between magnetic core segments situated within depressions 644, 646.

Figure 7:
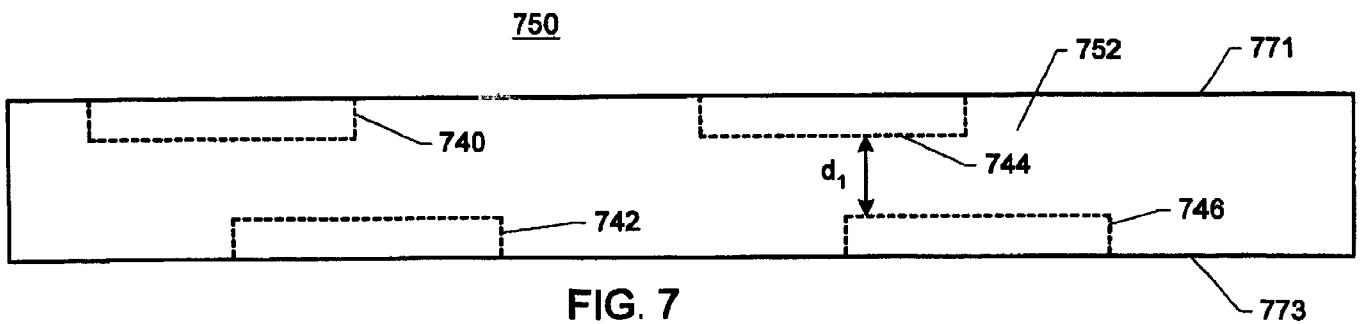
FIG. 7 is a simplified side view of the inductive circuit element illustrated in FIG. 3 showing a second alternate placement arrangement for magnetic core segments.

FIG. 7 is a simplified side view of the inductive circuit element illustrated in FIG. 3 showing a second alternate placement arrangement for magnetic core segments. In FIG. 7, an inductive circuit element 750 is arrayed in a base member 752. Base member 752 is a single substrate having a top face 771 and a bottom face 773.

Depressions 740, 744 are established in top face 771 appropriately dimensioned to nestlingly receive magnetic core segments (e.g., magnetic core segments 60, 64; FIG. 3). Depressions 742, 746 are established in bottom face 773 appropriately dimensioned to nestlingly receive magnetic core segments (e.g., magnetic core segments 62, 66; FIG. 3). Depressions 740, 744 partially extend into base member 752 from top face 771. Depressions 742, 746 partially extend into base member 752 from bottom face 773. A separation distance $d_1$ is thereby established between from depressions 740, 742 and between depressions 744, 746. Separation distance $d_1$ is preferably established at a dimension to permit magnetic flux coupling between magnetic core segments situated within depressions 740, 742 and between magnetic core segments situated within depressions 744, 746.

The advantages of manufacturing an inductive circuit element according to the structure and method disclosed in this specification include having an inductive circuit element with its magnetic core elements situated within its substrate or substrates. Thus there is provided a low profile device. In fact, the resulting device has no profile other than the substrates and other items carried thereon, such as capacitors, circuit traces and other similar electrical or electronic components. The bulky profile presented by prior art devices is eliminated.

An additional benefit of the structure and method of the present invention is that there is more "real estate" made available for circuit traces, components and other items. That is more area is available using the structure or method of the present invention than is available using prior art approaches for placing circuit parts and connecting them to create a product. This advantageous result is achieved principally because the "real estate" in the vicinity of the core elements is substantially fully available for carrying circuitry.

The availability of areas proximate to the core elements is also important because it facilitates locating components used in connection with or in support of the inductive circuit element in locations closely adjacent with the core elements. For example, when the inductive circuit element of the present invention is used in an LC (inductive capacitive) filter application, the additional inductances, capacitances and resistance that may occur because of supporting components and circuit traces necessary to connect the various components are reduced. Such "stray" inductances, capacitances and resistance are significantly reduced by using the structure or method of the present invention, and transient response of the circuit is improved because of the nearly adjacent location of components and the core of the inductive circuit element.

The advantages of low profile and available real estate are also available when the present invention is used for manufacturing an inductive circuit element as a module for use in another circuit rather than integrally created with a circuit. Either employment of the structure or method of the present invention yields similar advantages that include lower profile and fewer sources of "stray" inductance and capacitance.

Figure 8:
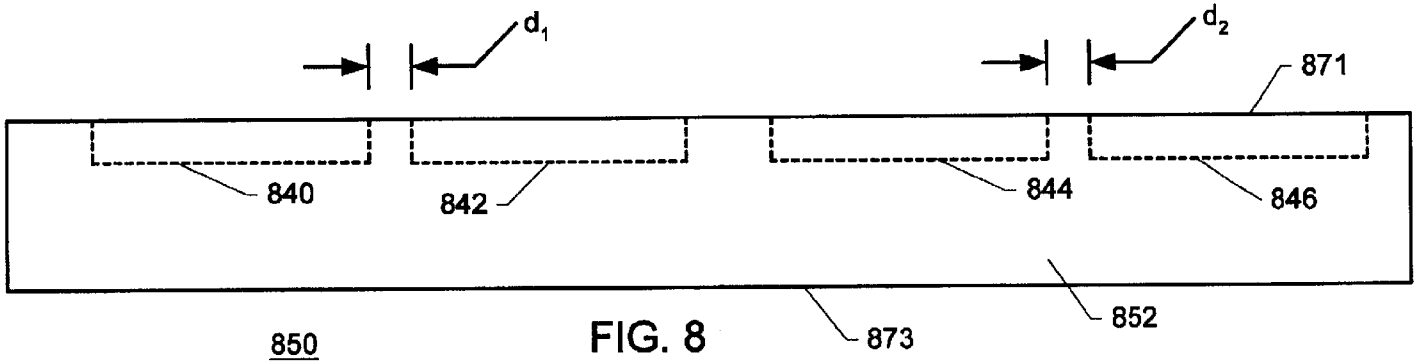
FIG. 8 is a simplified side view of the inductive circuit element illustrated in FIG. 3 showing a third alternate placement arrangement for magnetic core segments.

FIG. 8 is a simplified side view of the inductive circuit element illustrated in FIG. 3 showing a third alternate placement arrangement for magnetic core segments. In FIG. 8, an inductive circuit element 850 is arrayed in a base member 852. Base member 852 is a single substrate having a top face 871 and a bottom face 873.

Depressions 840, 842, 844, 846 are established in top face 871 appropriately dimensioned to nestlingly receive magnetic core segments (e.g., magnetic core segments 60, 64; FIG. 3). Depressions 840, 842, 844, 846 partially extend into base member 852 from top face 871. A separation distance $d_1$ is established between depressions 840, 842. Separation distance $d_1$ is preferably established at a dimension to permit magnetic flux coupling between magnetic core segments situated within depressions 840, 842. A separation distance $d_2$ is established between depressions 844, 846. Separation distance $d_2$ is preferably established at a dimension to permit magnetic flux coupling between magnetic core segments situated within depressions 844, 846.

Figure 9:
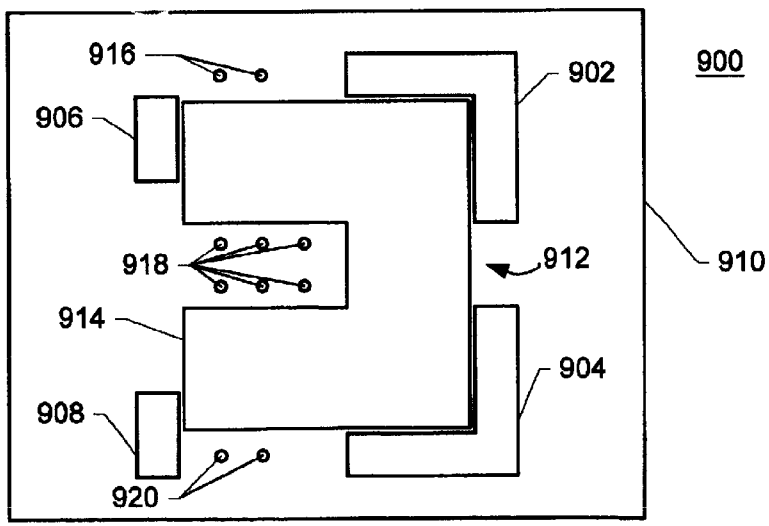
FIG. 9 is a plan view of a representative circuit layout illustrating an alternate structure for fixing position of a core segment in a product.

FIG. 9 is a plan view of a representative circuit layout illustrating an alternate structure for fixing position of a core segment in a product. In FIG. 9, a product 900 includes a plurality of etched lands 902, 904, 906, 908 on a substrate 910. Lands 902, 904, 906, 908 are preferably copper lands. Lands 902, 904, 906, 908 extend substantially perpendicularly from substrate 910 a distance sufficient to establish a thickness of lands 902, 904, 906, 908 (not shown in FIG. 9). The thickness of lands 902, 904, 906, 908 thus established are of sufficient dimension to form a fixture 912 for nestlingly fixing a core segment 914 against lateral movement in directions generally parallel with substrate 910. Preferably the thickness of lands 902, 904, 906, 908 is about one-half the thickness of core segment 914, or greater. Through-holes 916, 918, 920 may be provided configured, for example, for solder-filling to contribute to establishing loops about core segment 914.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following

We claim:

1. An apparatus for effecting inductive coupling with a ferromagnetic core structure; the apparatus comprising:

(a) at least one substrate of a dielectric material; at least one selected substrate of said at least one substrate being configured with at least one fixture; each said at least one fixture being dimensioned for receiving a respective core segment; a core segment sets including at least two said core segments is received by said at least one fixture and separated by a volume of said dielectric material; said core segment sets being arranged for establishing magnetic flux coupling among said at least two core segments to establish said ferromagnetic core structure when said at least one substrate is in an assembled orientation with said ferromagnetic core structure and said at least one substrate arranged in a unitary structural relationship;

(b) a plurality of electrically conductive circuit traces; said plurality of circuit traces being arrayed upon at least two predetermined surfaces of said at least one substrate;

(c) a plurality of electrically conductive through-hole structures; said plurality of through-hole structures traversing said at least one selected substrate;

said plurality of circuit traces and said plurality of through-hole structures cooperating to establish said inductive coupling when said at least one substrate is in said assembled orientation.

2. An apparatus for effecting inductive coupling with a ferromagnetic core structure as recited in claim 1 wherein said at least one substrate is a plurality of substrates, and wherein each respective substrate of said plurality of substrates is substantially planar, and wherein said assembled orientation abuttingly situates said plurality of substrates substantially in parallel in said unitary structural relationship.

3. An apparatus for effecting inductive coupling with a ferromagnetic core structure as recited in claim 1 wherein said inductive coupling establishes an inductor element including said ferromagnetic core structure.

4. An apparatus for effecting inductive coupling with a ferromagnetic core structure as recited in claim 1 wherein said inductive coupling establishes a transformer element including said ferromagnetic core structure.

5. An apparatus for effecting inductive coupling with a ferromagnetic core structure as recited in claim 1 wherein each said respective core segment is embodied in a pliable magnetic material.

6. An apparatus for effecting inductive coupling with a ferromagnetic core structure as recited in claim 5 wherein said pliable magnetic material is a magnetically loaded paste material.

7. An apparatus for effecting inductive coupling with a ferromagnetic core structure as recited in claim 5 wherein said pliable magnetic material is a magnetically loaded polymer composite sheet material.

8. An apparatus for effecting inductive coupling with a ferromagnetic core structure as recited in claim 2 wherein said inductive coupling establishes an inductor element including said ferromagnetic core structure.

9. An apparatus for effecting inductive coupling with a ferromagnetic core structure as recited in claim 2 wherein said inductive coupling establishes a transformer element including said ferromagnetic core structure.

10. An apparatus for effecting inductive coupling with a ferromagnetic core structure as recited in claim 2 wherein each said respective core segment is embodied in a pliable magnetic material.

11. An apparatus for effecting inductive coupling with a ferromagnetic core structure as recited in claim 10 wherein said pliable magnetic material is a magnetically loaded paste material.

12. An apparatus for effecting inductive coupling with a ferromagnetic core structure as recited in claim 10 wherein said pliable magnetic material is a magnetically loaded polymer composite sheet material.

* * * * *